US010149578B2

(12) United States Patent
Kreuter

(10) Patent No.: US 10,149,578 B2
(45) Date of Patent: Dec. 11, 2018

(54) PAPER TOWEL DISPENSERS

(71) Applicant: Wisconsin Plastics, Inc., Green Bay, WI (US)

(72) Inventor: Kacey Kreuter, Green Bay, WI (US)

(73) Assignee: Wisconsin Plastics, Inc., Geen Bay, WI (US)

( * ) Notice: Subject to any disclaimer, the term of this patent is extended or adjusted under 35 U.S.C. 154(b) by 107 days.

(21) Appl. No.: 15/297,758

(22) Filed: Oct. 19, 2016

(65) Prior Publication Data

US 2017/0105589 A1 Apr. 20, 2017

Related U.S. Application Data

(60) Provisional application No. 62/243,729, filed on Oct. 20, 2015.

(51) Int. Cl.

| | |
|---|---|
| ***A47K 10/32*** | (2006.01) |
| ***A47K 10/36*** | (2006.01) |
| ***A47K 10/38*** | (2006.01) |

(52) U.S. Cl.

CPC .. *A47K 10/3818* (2013.01); *A47K 2010/3233* (2013.01); *A47K 2010/3681* (2013.01)

(58) Field of Classification Search

CPC ..... A47K 10/38; A47K 10/3818; A47K 2010/3206; A47K 2010/3233; B65H 18/02

See application file for complete search history.

(56) References Cited

U.S. PATENT DOCUMENTS

| | | | | |
|---|---|---|---|---|
| 5,246,137 | A | 9/1993 | Schutz et al. | |
| 5,310,083 | A | 5/1994 | Rizzuto | |
| 5,370,338 | A * | 12/1994 | Lewis | A47K 10/3818 206/409 |
| 5,715,971 | A | 2/1998 | Morand | |
| 5,749,492 | A * | 5/1998 | Petterson | A47K 10/3818 221/1 |
| 5,765,718 | A * | 6/1998 | Grasso | A47K 10/3818 221/1 |
| 6,267,321 | B1 * | 7/2001 | Tramontina | A47K 10/3818 206/409 |
| 6,328,252 | B1 | 12/2001 | Neveu et al. | |
| 6,510,964 | B2 * | 1/2003 | Paukov | A47K 10/3818 221/303 |
| 6,592,001 | B2 * | 7/2003 | Lewis | A47K 10/3818 221/304 |
| 6,869,041 | B1 * | 3/2005 | Allegre | A47K 10/3818 206/409 |
| 7,040,568 | B2 | 5/2006 | Lewis et al. | |

(Continued)

*Primary Examiner* — William A. Rivera
(74) *Attorney, Agent, or Firm* — Andrus Intellectual Property Law, LLP

(57) ABSTRACT

A paper towel dispenser for dispensing paper towels from a continuous roll of paper towels includes a dispensing body configured to dispense paper towels. The dispensing body has an upstream inlet configured to receive the paper towels and a downstream outlet configured to dispense the paper towel. The dispensing body defines a cutout that extends between the upstream inlet and the downstream outlet through which the paper towels are moved to load the paper towels into the dispensing body. The dispenser includes a closure device configured to be received in the cutout and restrain the paper towels in the dispensing body.

19 Claims, 16 Drawing Sheets

(56) References Cited

U.S. PATENT DOCUMENTS

| | | | | |
|---|---|---|---|---|
| 7,131,609 | B1 * | 11/2006 | Lewis | A47K 10/3818 242/593 |
| 7,275,655 | B2 | 10/2007 | Duff | |
| 7,275,672 | B2 | 10/2007 | Haen et al. | |
| 7,287,720 | B1 * | 10/2007 | Allegre | A47K 10/38 206/409 |
| 7,510,137 | B2 | 3/2009 | Tramontina et al. | |
| 7,878,368 | B2 * | 2/2011 | Friesen | A47K 10/3818 221/44 |
| 7,997,443 | B2 | 8/2011 | Titas et al. | |

* cited by examiner

PAPER TOWEL DISPENSERS

CROSS-REFERENCE TO RELATED APPLICATION

The present application claims benefit of and priority to U.S. Provisional Application No. 62/243,729 filed on Oct. 20, 2015, which is hereby incorporated herein by reference.

FIELD

The present disclosure relates to paper towel dispensers, specifically centerpull paper towel dispensers.

BACKGROUND

The following U.S. patents are hereby incorporated herein by reference in entirety.

U.S. Pat. No. 7,131,609 discloses a dispenser adapted to dispense sheet material therefrom. The dispenser includes a housing including a base and a cover. The base includes a platform configured to support sheet material. The platform includes a dispensing disk and the platform has an outer perimeter intersected by a slot thereby providing an opening into the platform and dispensing disk. The housing is formed to include an exit port spaced apart from the platform and dispensing disk. The cover includes a rotatable disk having a plurality of user interchangeable dispensing slots of differing diameters intersecting an outer periphery of the rotatable disk. Sheet material positioned on the platform flows through the dispensing opening of the dispensing disk and through a selected one of the plurality of dispensing slots. The selected one of the plurality of dispensing slots is aligned with the exit port. The sheet material disposed in the dispenser flows between the opening in the dispensing disk, through at least one space, through the selected one of the plurality of dispensing slots and through the exit port to be dispensed.

U.S. Pat. No. 7,510,137 discloses a dispenser adapted to vertically dispense sheet material therefrom. The dispenser includes a housing configured to support a sheet material product therein, a platform with an opening, and an exit plate. The exit plate is adapted to reposition when the sheet material is dispensed by the user at a deflection angle relative to the vertical dispensing axis of the dispenser.

U.S. Pat. No. 7,997,443 discloses a center-pull dispenser for dispensing paper towels from a continuous roll, wherein each individual towel is separated from an adjoining towel by a plurality of perforations. The dispenser comprises a housing having a housing back and a detachable front cover hingedly connected at the lower periphery of the housing back and front cover for opening and closing the housing, a paper support tray removably connected to a lower portion of the housing back, the tray having a centrally located dispensing nozzle and at least one locking element for releasably locking at least one first hinge element on the lower periphery of the front cover to at least one second hinge element on the lower periphery of the housing back, an opening in the lower periphery of said housing through which the towels are dispensed, and a wall-mounting member for removably mounting the housing back to a wall. The paper support tray can include locking arms for releasably locking first hinge elements on the lower periphery of said front cover against second hinge elements on the lower periphery of said housing back. The dispenser can include a locking member for releasably locking the front cover to the housing back and the housing back to the wall-mounting member.

SUMMARY

This Summary is provided herein to introduce a selection of concepts that are further described herein below in the Detailed Description. This Summary is not intended to identify key or essential features from the claimed subject matter, nor is it intended to be used as an aid in limiting the scope of the claimed subject matter.

In certain examples, a paper towel dispenser for dispensing paper towels from a continuous roll of paper towels includes a dispensing body configured to dispense paper towels. The dispensing body has an upstream inlet configured to receive the paper towels and a downstream outlet configured to dispense the paper towel. The dispensing body defines a cutout that extends between the upstream inlet and the downstream outlet through which the paper towels are moved to load the paper towels into the dispensing body. The dispenser includes a closure device configured to be received in the cutout and restrain the paper towels in the dispensing body.

In certain examples, a paper towel dispenser for dispensing paper towels from a continuous roll of paper towels includes a housing defining an interior space, a platform configured to support the continuous roll of paper towels, and carousel having a plurality of dispensing bodies for dispensing paper towels therethrough. The platform is received in the interior space and coupled to the housing, and the carousel is rotatably coupled to the platform. The carousel rotates such that one of the plurality of dispensing bodies is positioned in a dispensing position and the paper towels dispense through the dispensing body positioned in the dispensing position.

In certain examples, a carousel for a paper towel dispenser configured to dispense paper towels from a continuous roll of paper towels includes a plurality of dispensing bodies that are configured to dispense paper towels. The carousel is configured to rotate such that one of the plurality of dispensing bodies is positioned in a dispensing position and the paper towels dispense through the dispensing body positioned in the dispensing position. Each of the dispensing bodies comprises an upstream inlet configured to receive the paper towel and a downstream outlet configured to dispense the paper towel. The dispensing body defines a cutout that extends between the upstream inlet and the downstream outlet through which the paper towels are moved to thereby load the paper towels into the dispensing body positioned in the dispensing position.

BRIEF DESCRIPTION OF THE DRAWINGS

Examples of paper towel dispensers are described with reference to the following drawing figures. The same numbers are used throughout the drawing figures to reference like features and components.

DETAILED DESCRIPTION OF THE DRAWINGS

Figure 1:
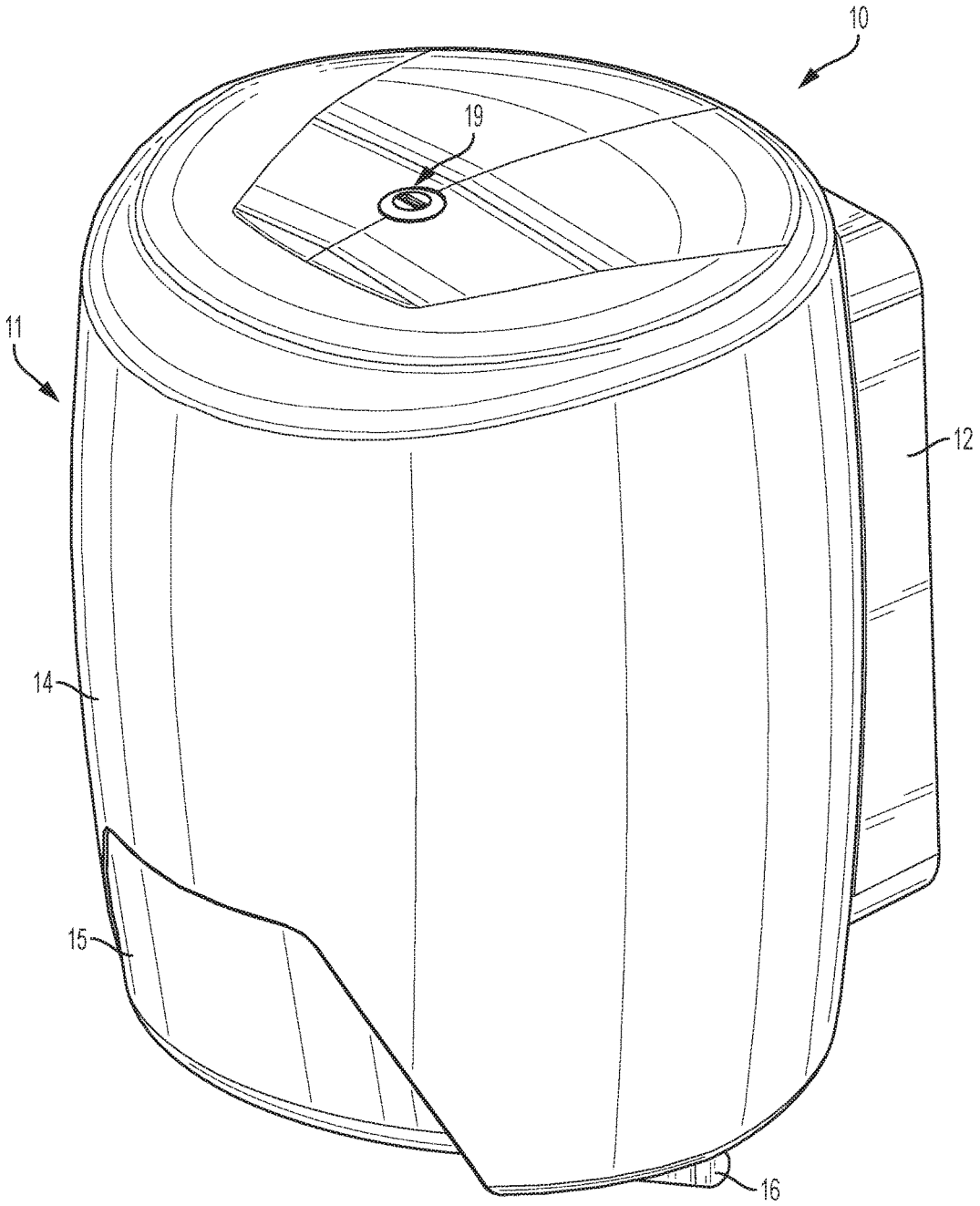
FIG. 1 is a perspective view of an example paper towel dispenser.
Figure 2:
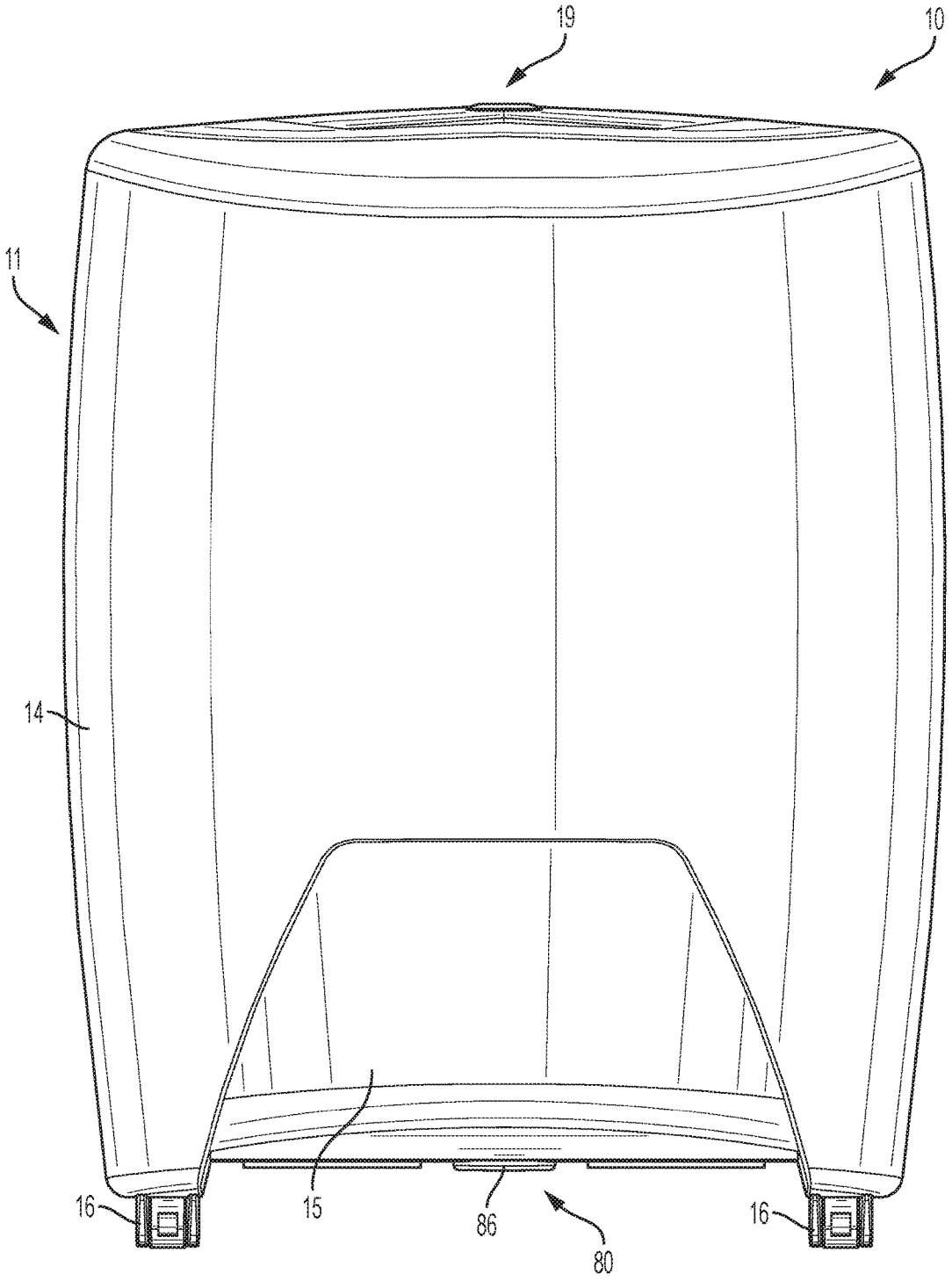
FIG. 2 is a front view of the paper towel dispenser of FIG. 1.
Figure 3:
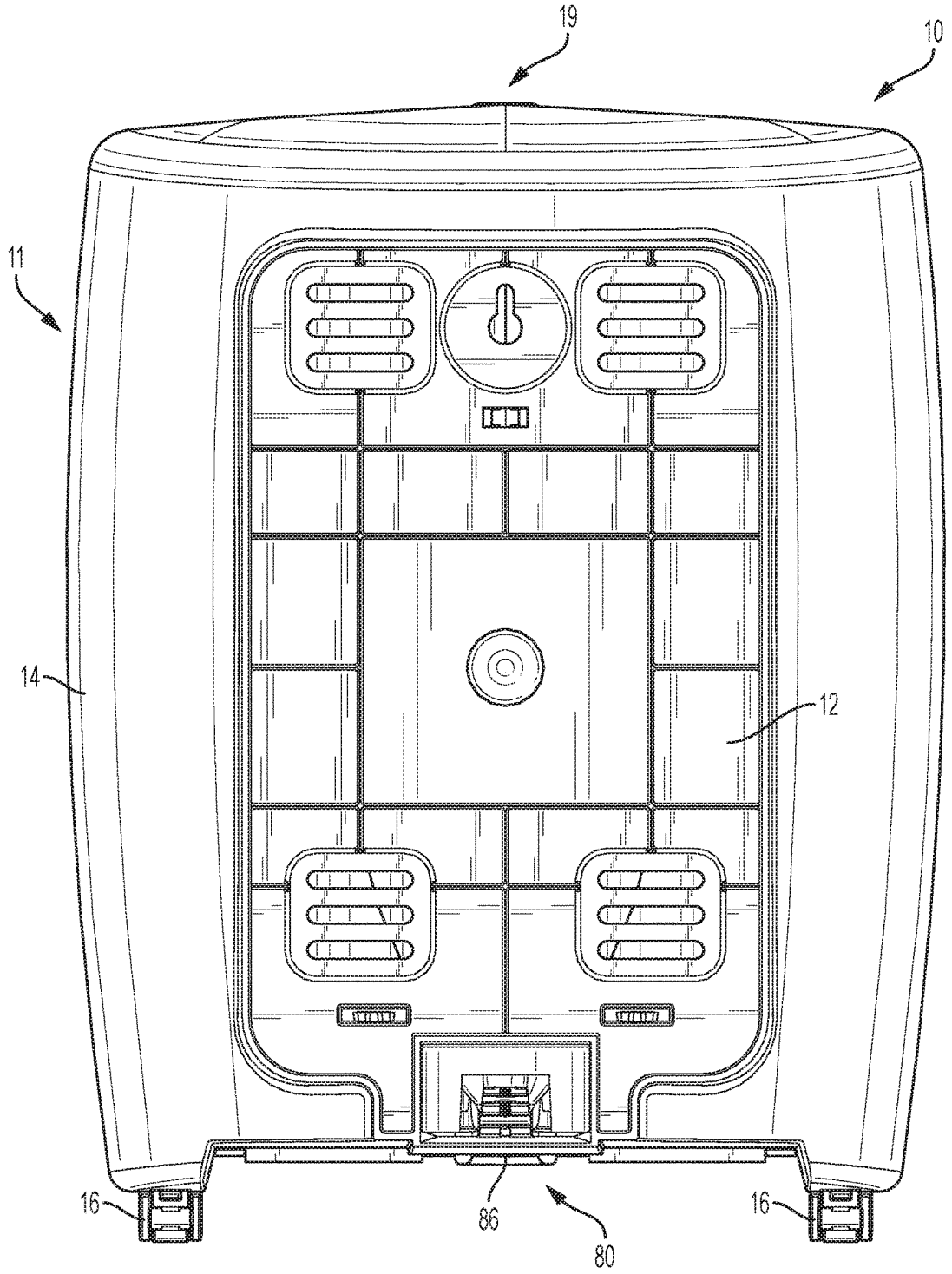
FIG. 3 is a back view of the paper towel dispenser of FIG. 1.
Figure 4:
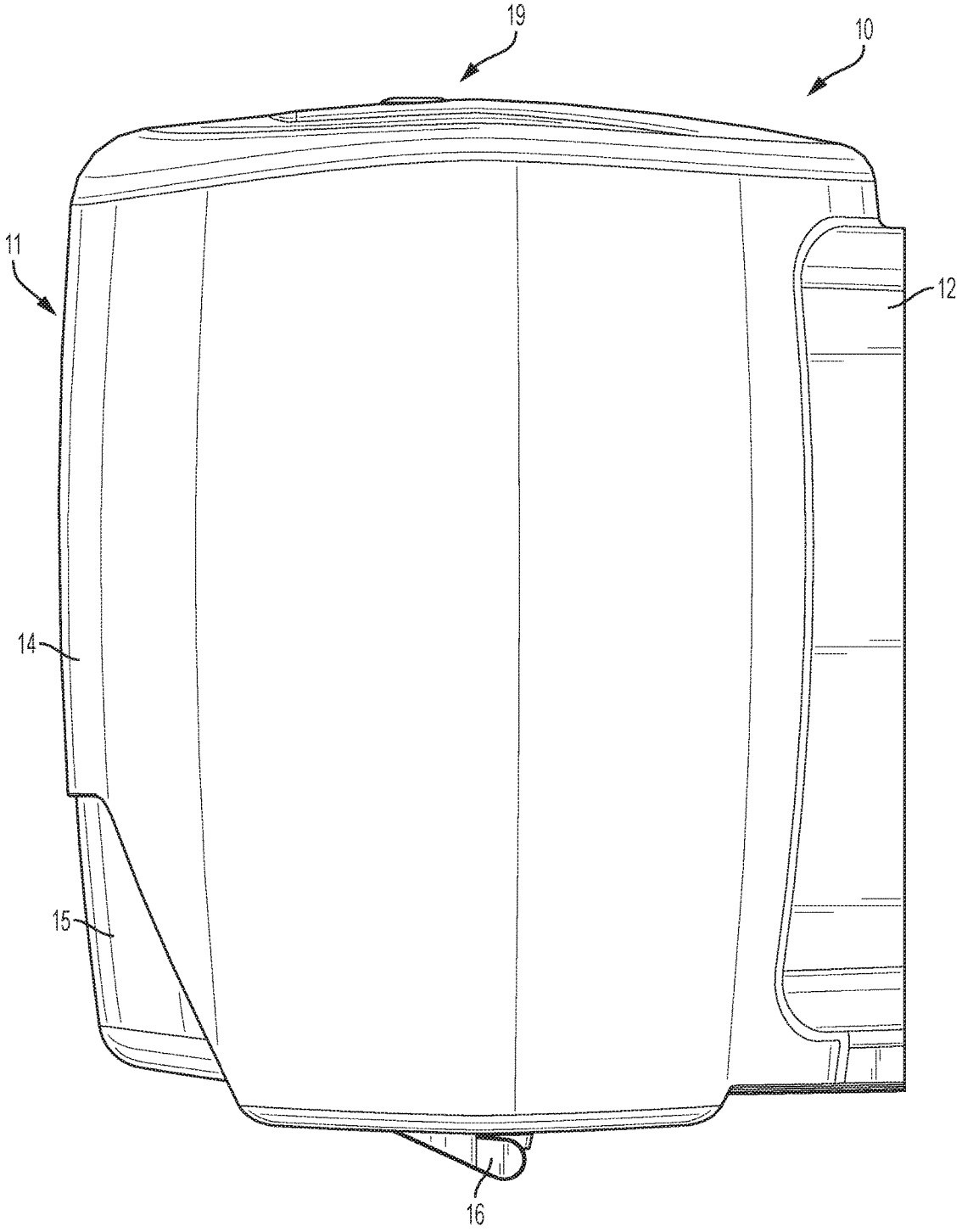
FIG. 4 is a first side view of the paper towel dispenser of FIG. 1.
Figure 5:
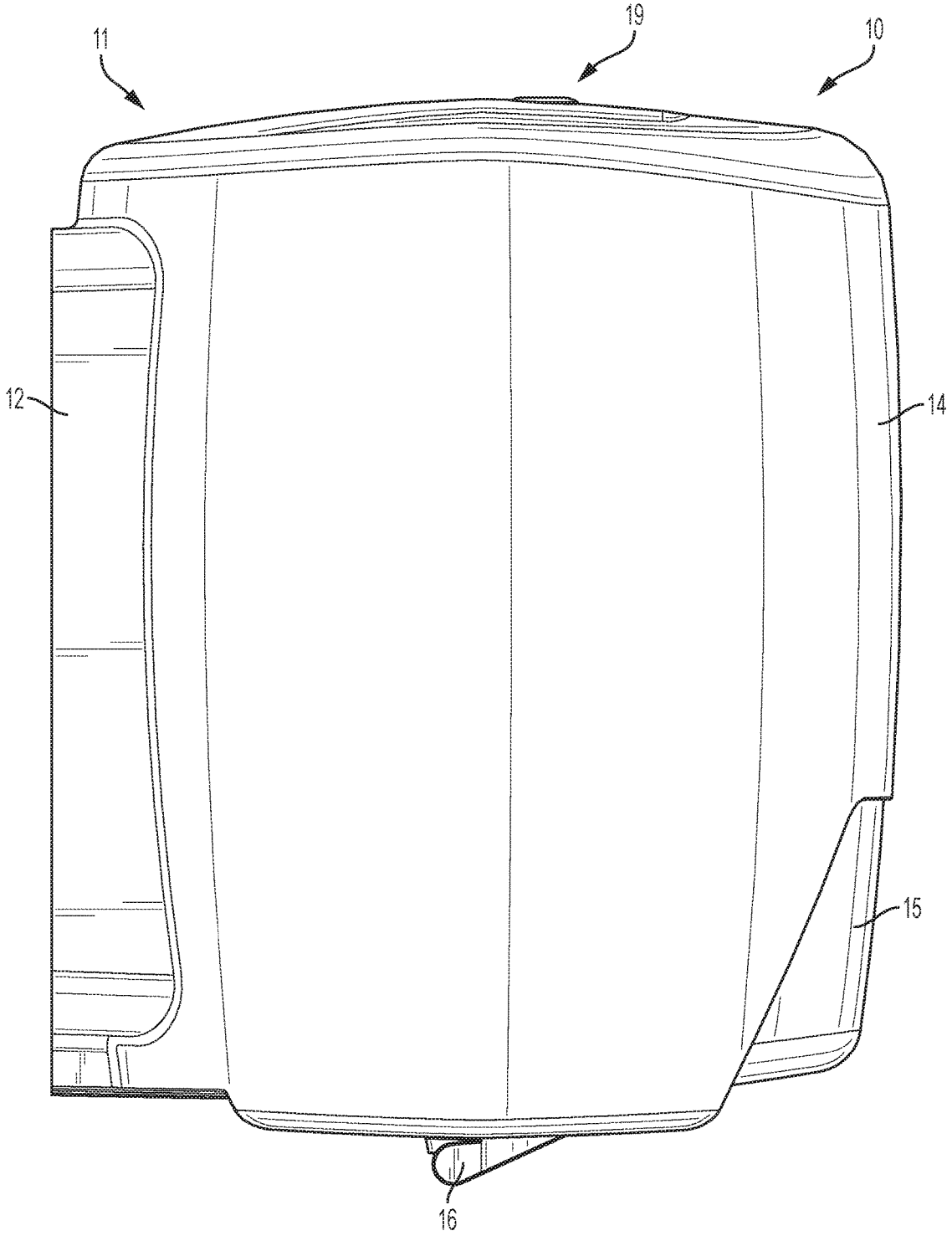
FIG. 5 is a second side view of the paper towel dispenser of FIG. 1.
Figure 6:
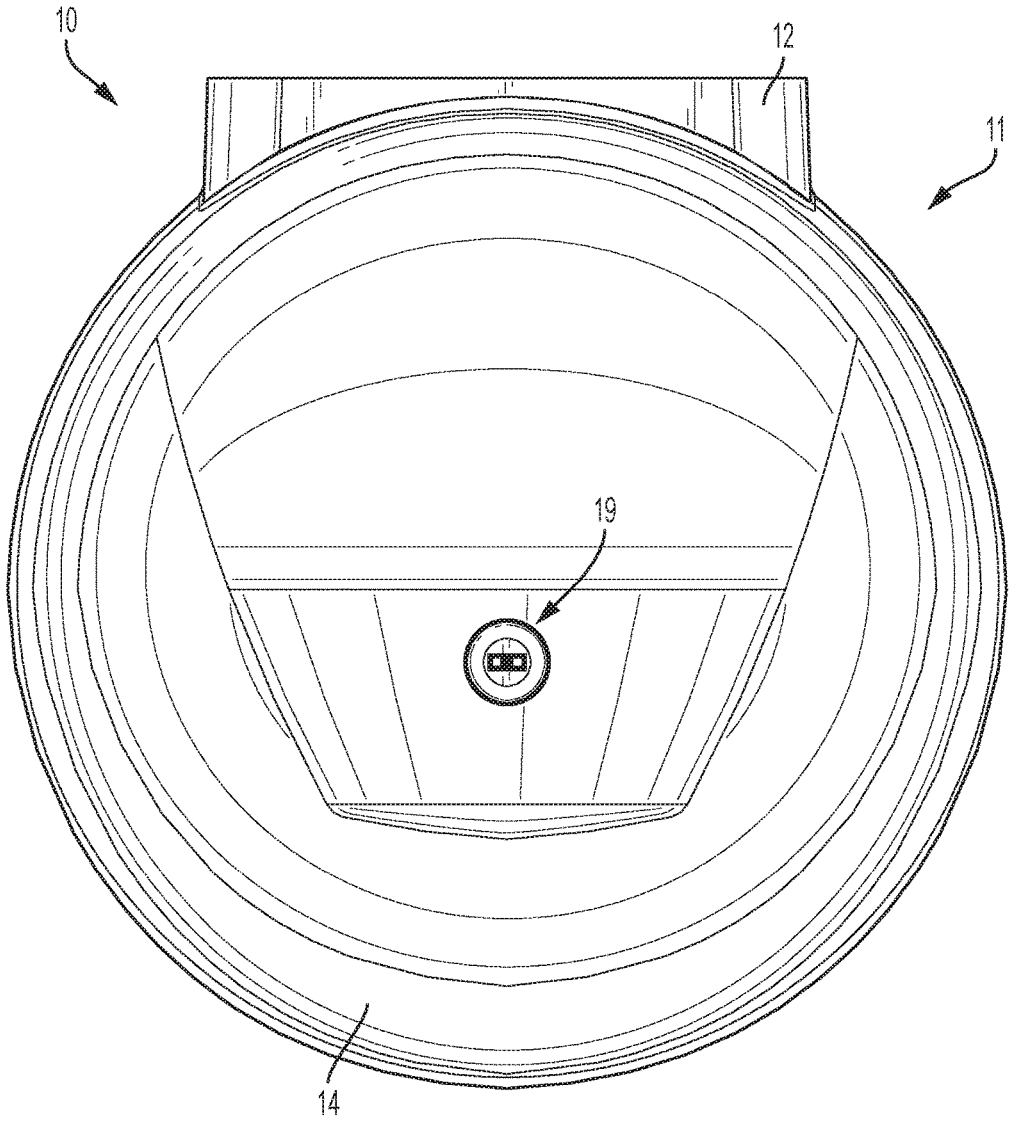
FIG. 6 is a top view of the paper towel dispenser of FIG. 1.

In the present disclosure, certain terms have been used for brevity, clarity and understanding. No unnecessary limitations are to be inferred therefrom beyond the requirements of the prior art because such terms are used for descriptive purposes and are intended to be broadly construed. The present disclosure provides examples of paper towel dispensers that effectively dispense paper towels.

Paper towel dispensers for continuous rolls of paper towels often have a dispensing outlet or opening that permits the paper towels to be dispensed therethrough. The continuous roll of paper towels is placed in the dispenser, and loading/reloading the continuous roll of paper towels can be time consuming and requires that an operator thread a length of the paper towels through the outlet in order to "load" the paper towels for use. The present invention recognizes these problems and endeavors to provide a dispenser that is easy-to-use, efficient, and long-lasting. Accordingly, herein disclosed is a paper towel dispenser that utilizes a closure device to restrain the paper towel in the outlet and keep the operators hands and fingers from being pinched.

Referring to FIGS. 1-7, a paper towel dispenser 10 for dispensing paper towels from a continuous roll of paper towels (not shown) is depicted. The dispenser 10 has a housing 11 that includes a base 12 which is configured to contact and attach to a support structure (e.g. wall) and a door 14 that is rotatably and/or pivotally coupled to the base 12 with a hinge 16. The housing 11 defines an interior space 18 (see FIGS. 15-16) in which the continuous roll of paper towels is received. The base 12 and the door 14 protect the continuous roll of paper towels from external conditions (e.g. moisture, dirt, sun). The hinge 16 allows the door 14 to move and/or pivot relative to the base 12 and/or a platform 20 (see FIG. 15) (described further herein) such that an operator can load and/or replace the continuous roll of paper towels into the dispenser 10 and/or perform maintenance on the dispenser 10. The base 12 includes a support channel 13 configured to support the platform 20 on the base 12 (see FIG. 8). In certain examples, a lock assembly 19 secures the base 12 to the door 14. In certain examples, the door 14 includes a removable access plate 15.

Referring to FIGS. 8-12, the paper towel dispenser 10 includes a platform 20 defining an opening 21 that is configured to rotatably receive a carousel 40. The platform 20 is coupled to the base 12 and configured to support the continuous roll of paper towels. The platform 20 defines a platform cutout 22 through which paper towels are moved to thereby load the paper towels into the dispensing body 42 (described herein). The platform 20 is positioned in the interior space 18. The platform 20 has a surface 24 on which the continuous roll of paper towels is supported and a flange member 26 that projects into the opening 21 to support the carousel 40. The platform 20 includes a notch 28 that is configured to receive a tab 66 of the carousel 40.

The carousel 40 has at least one or a plurality of dispensing bodies 42 configured to dispense paper towels therethrough. The number of dispensing bodies 42 can vary. In the example depicted in FIG. 8, the carousel includes three dispensing bodies 42. The carousel 40 is configured to rotate such that one of the plurality of dispensing bodies 42 is positioned in a dispensing position (see FIG. 10, the dispensing body 42 that aligns with the platform cutout 22 is in the dispensing position) such that the paper towels are configured to dispense through the dispensing body 42 positioned in the dispensing position. The carousel 40 includes an upper surface 52 that is coplaner with the surface 24 of the platform 20 when the carousel 40 is received in the opening 21. The carousel 40 is rotatably coupled to the base 12 or the platform 20 by a coupler device 64 (e.g. screw, nut and bolt, snap fitting). The carousel 40 includes tabs 66 that are received in the notches 28 such that the operator can "lock" or "set" the position of the carousel 40. The tabs 66 are configured to elastically deform when a preselected rotation force is applied to the carousel 40 such that the tabs 66 contact the platform 20 as the tabs 66 move between the notches 28, and the tabs 66 revert to the undeformed shape when the tabs 66 are received into the notches 28. In certain examples, the carousel 40 is integral with the platform 20 and formed/manufactured as a single component such that the carousel 40 is indistinguishable from the platform 20. The dispensing body 42 can be any suitable shape, such as a circular cone, truncated cone, rectangular cone, spherical, and/or the like.

Each dispensing body 42 axially extends between an upstream inlet 44 configured to receive the paper towels and a downstream outlet 47 configured to dispense the paper towels. The dispensing body 42 defines a cutout 43 that extends between the upstream inlet 44 and the downstream outlet 47. The paper towels are loaded into the dispensing body 42 by moving a length of paper towels from the continuous roll of paper towels through the cutout 43. The dispensing body 42 includes a surface 60 that extends between the upstream inlet 44 and the downstream outlet 47. In certain examples, the surface 60 slopes radially inwardly from the upstream inlet 44 to the downstream outlet 47 (see FIGS. 9, 10, and 12). In certain examples, a neck 53 is coupled to the downstream outlet 47 (see FIGS. 9 and 11). The neck 53 configured to resist wear as the paper towels are pulled through the dispensing body 42 and into contact with the neck 53.

Figure 9:
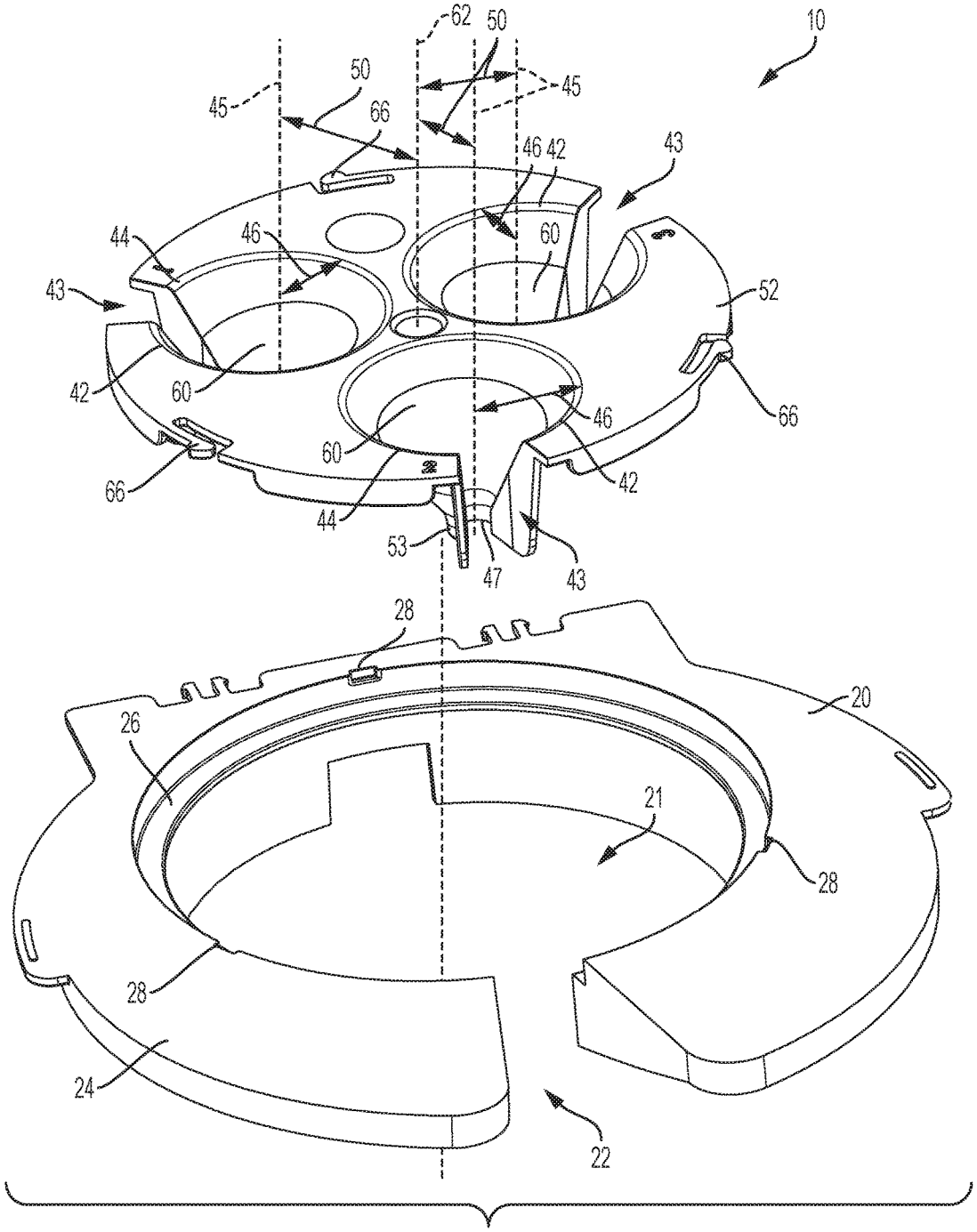
FIG. 9 is an exploded view of the platform and the carousel of FIG. 1.
Figure 10:
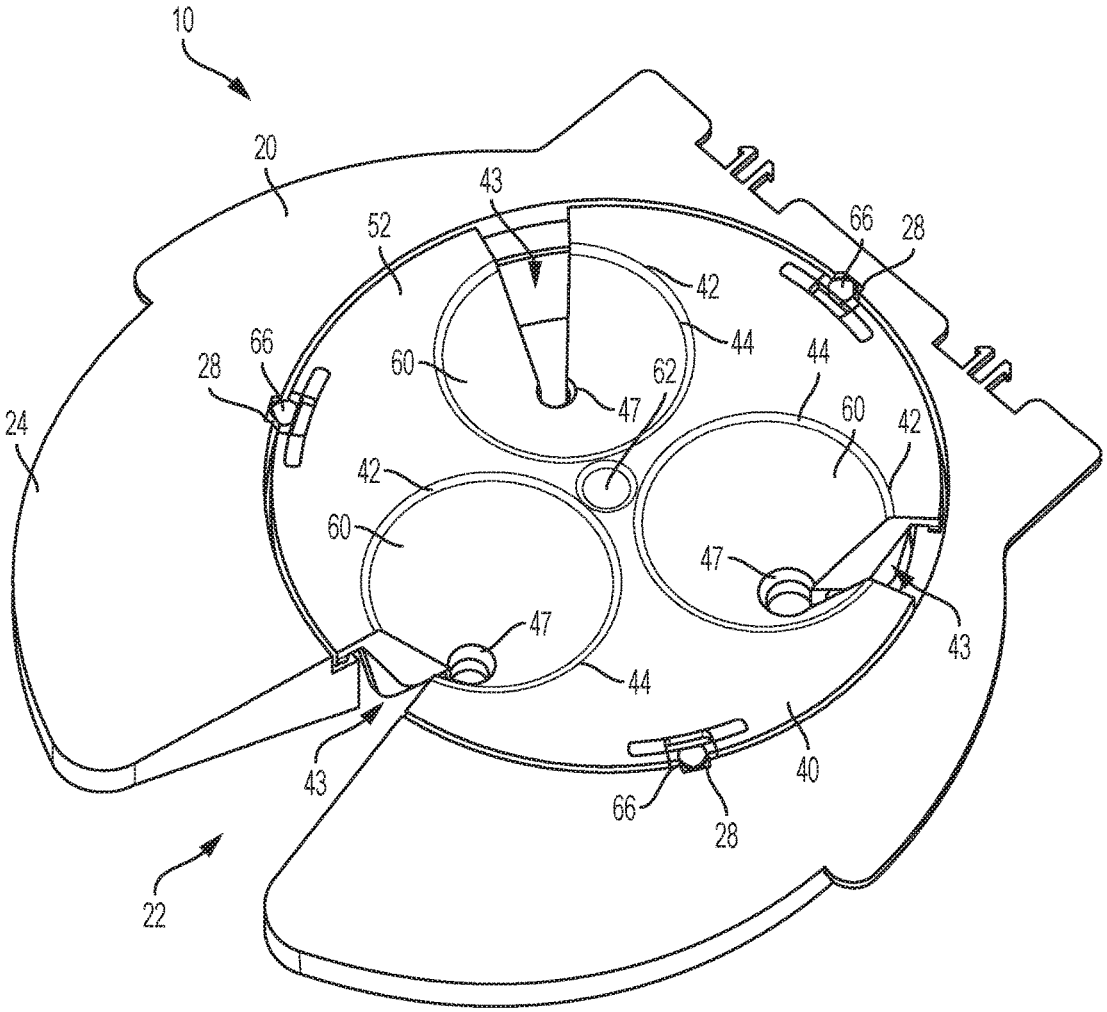
FIG. 10 is an example of a platform and a carousel.
Figure 11:
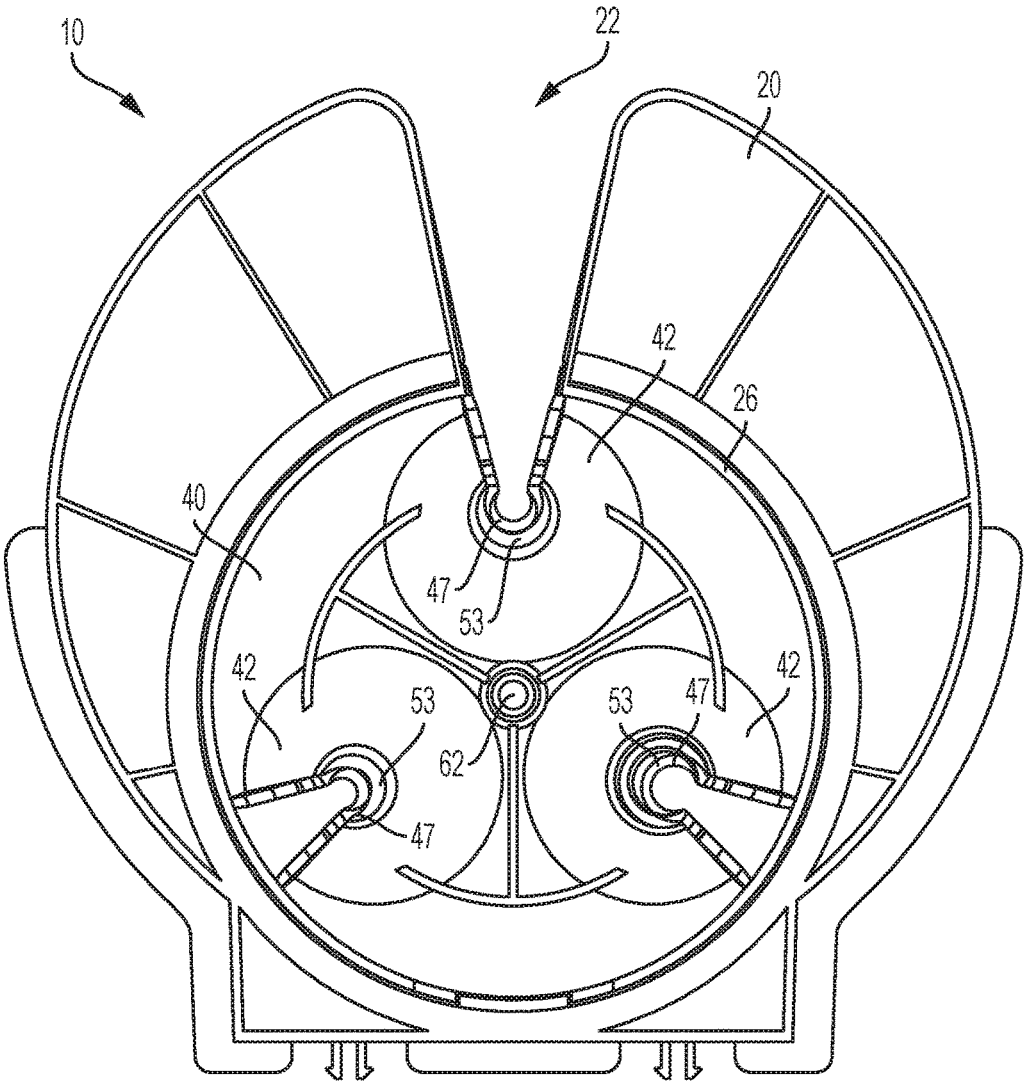
FIG. 11 is a bottom view of the platform and the carousel of FIG. 10.
Figure 13A:
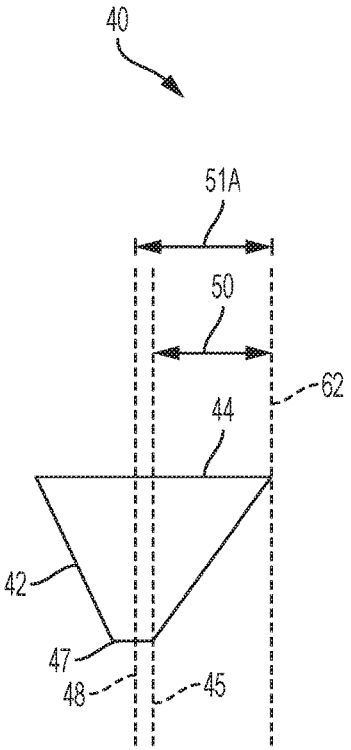
FIGS. 13A-13C are example cross section views of example dispensing bodies.
Figure 13B:
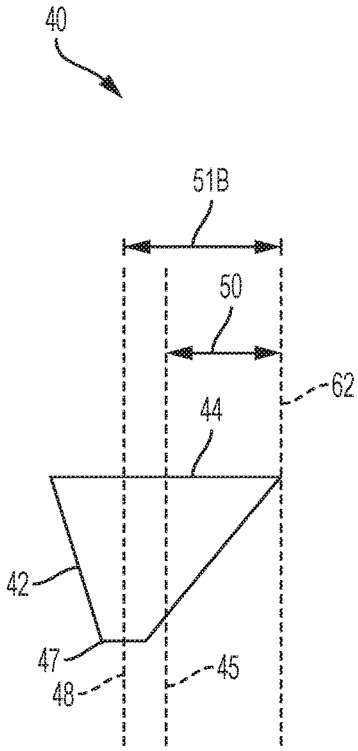
Figure 13C:
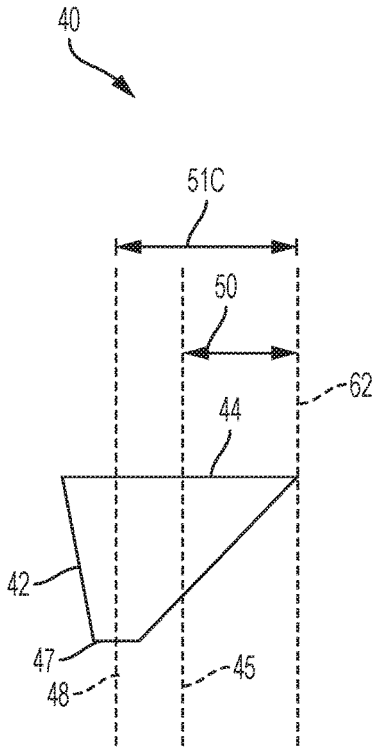

The upstream inlet 44 defines an inlet axis 45 and has an inlet radius 46 (see FIG. 9). In certain examples, the inlet radii 46 of the plurality of dispensing bodies 42 are equivalent (e.g. a first inlet radius 46 is equivalent to a second inlet radius 46 which is equivalent to a third inlet radius 46) (see FIG. 9). In other examples, the inlet radii 46 vary. The inlet axis 45 is spaced apart from a center axis 62 defined by the carousel 40 by a distance 50 (see FIG. 9). In certain examples, the distance 50 between the center axis 62 and each inlet axis 45 are equivalent (e.g. the inlet axes 45 are equidistant from the center axis 62 for each dispensing body 42; the distance 50 between a first inlet axis 45 and the center axis 62 is equivalent to the distance 50 between a second inlet axis 45 and the center axis 62) (see FIGS. 13A-13C). In other examples, the distance 50 between the center axis 62 and each inlet axis 45 varies.

Figure 12:
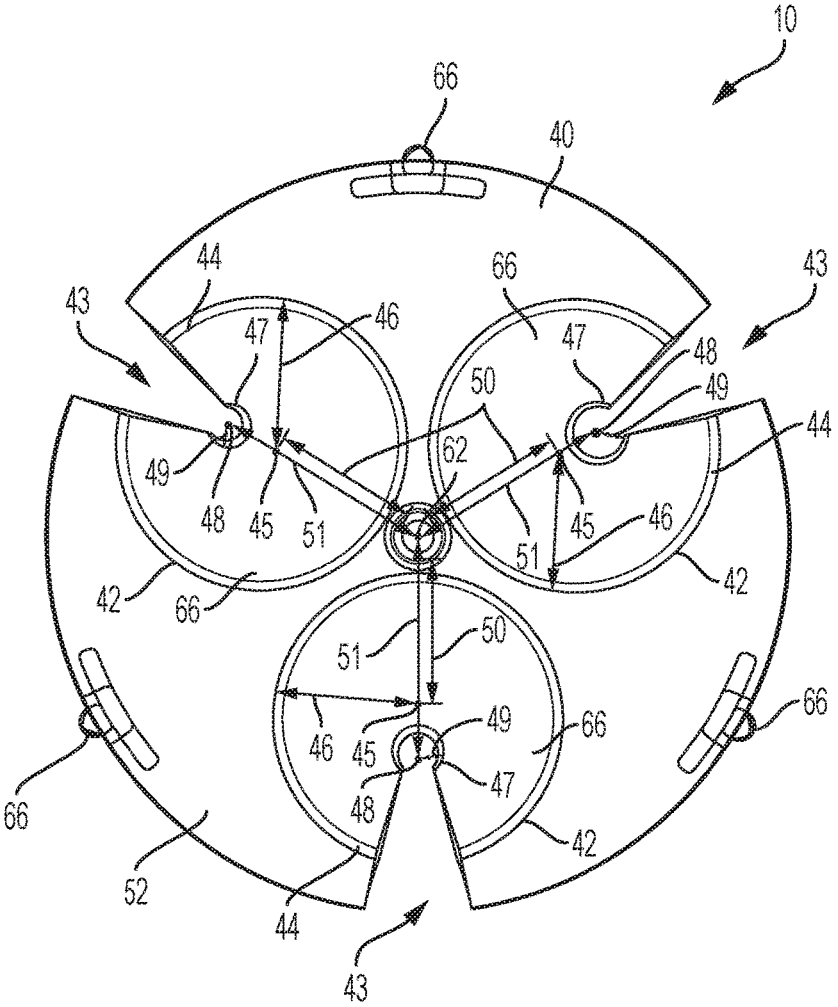
FIG. 12 is a top view of the carousel of FIG. 10.

The downstream outlet 47 defines an outlet axis 48 and has an outlet radius 49 (see FIG. 12). In certain examples, the outlet radii 49 of the plurality of dispensing bodies 42 are equivalent (e.g. a first outlet radius 49 is equivalent to a second outlet radius 49 which is equivalent to a third outlet radius 49) (see also FIGS. 13A-13C). Carousels 40 having dispensing bodies 42 with equivalent outlet radii 49 can be utilized, for example, in facilities that use a single type of paper towels. As the wear member 86 (as described below) and/or the downstream outlet 47 wear, the paper towels may not correctly dispense (i.e. the paper towels do not disconnect from each other at the perforation line (due to lack of tension or friction)) such that the paper towels "chain". To prevent the "chaining" of paper towels, an unworn dispensing body 42 can be rotated into the dispensing position thereby increasing the effective life of the dispenser 10.

In other examples, the outlet radii 49 vary (see FIG. 12). The center axis 62 of the carousel 40 and the outlet axis 48 are spaced apart at a distance 51. Carousels 40 having dispensing bodies 42 with different outlet radii 49 can be utilized in facilities what use multiple continuous rolls of paper towels that have varying grades, thickness, and/or abrasive characteristics. For instance, thick paper towels may require a larger downstream outlet 47 than thin paper towels and a dispensing body 42 having a large outlet radius 49 can be rotated to the dispensing position to accommodate the thick paper towels.

In certain examples, the distance 51 between the center axis 62 and the outlet axis 48 are equivalent (e.g. the outlet axes 48 are equidistant from the center axis 62 for each dispensing body 42; the distance 51 between a first outlet axis 48 and the center axis 62 is equivalent to the distance 51 between a second outlet axis 48 and the center axis 62). In other examples, the distance 51 between the outlet axis 48 and the center axis 62 varies. For example, referring to FIGS. 13A-13C, cross sections of a first dispensing body 42 (FIG. 13A), a second dispensing body 42 (FIG. 13B), and a third dispensing body 42 (FIG. 13C) of an example carousel 40 having a plurality of dispensing bodies 42 are depicted. The first dispensing body 42 of the plurality of dispensing bodies 42 defines a first outlet axis 48 that is spaced apart from the center axis 62 by a first distance 51A (see FIG. 13A); the second dispensing body 42 of the plurality of dispensing bodies 42 defines a second outlet axis 48 that is spaced apart from the center axis 62 by a second distance 51B which is greater than the first distance 51A (see FIG. 13B); and the third dispensing body 42 of the plurality of dispensing bodies 42 defines a third outlet axis 48 that is spaced apart from the center axis 62 by a third distance 51C which is greater than the second distance 51B (see FIG. 13C).

Figure 14:
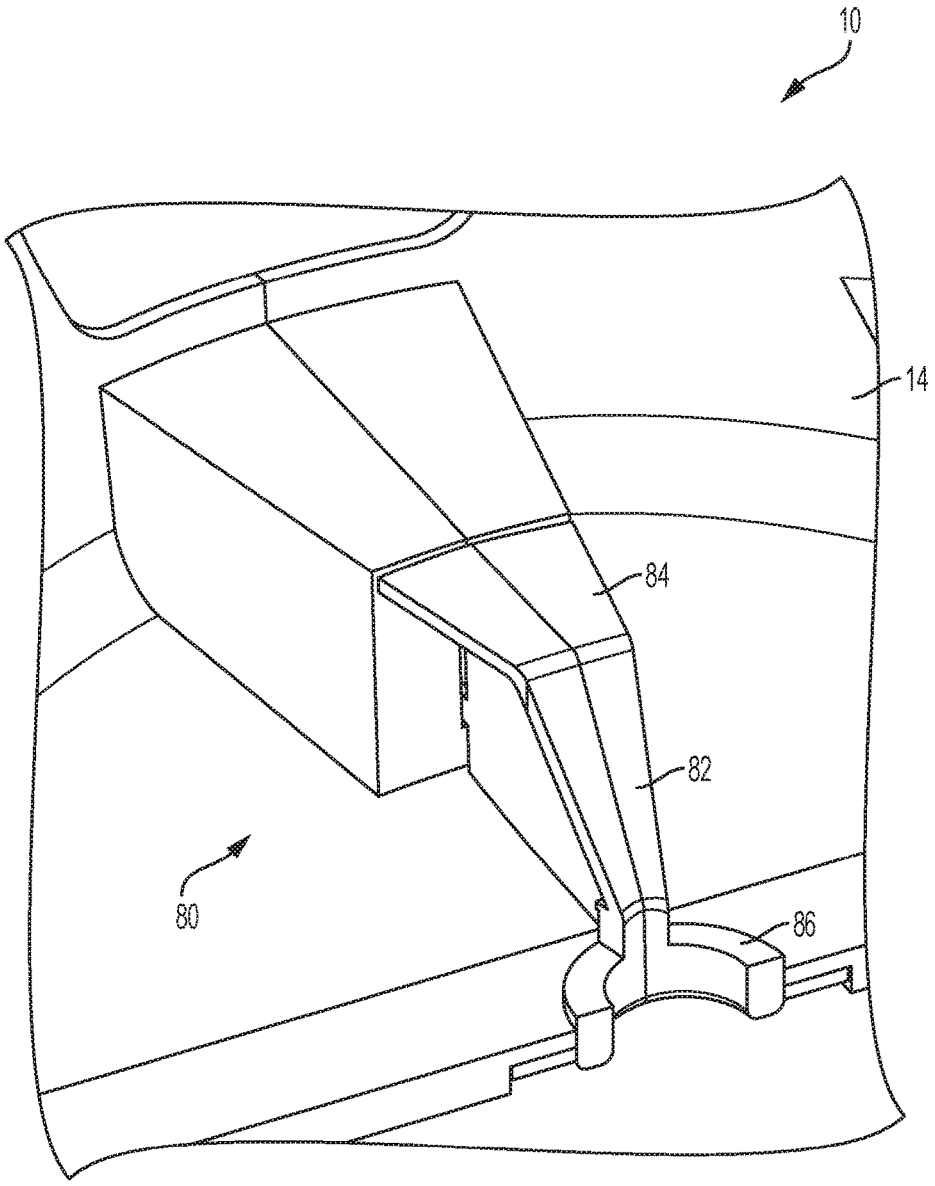
FIG. 14 is an enlarged view of an example closure device coupled to a door.

Referring to FIG. 14, the paper towel dispenser 10 includes a closure device 80 that corresponds with and/or is configured to be received in (or mate with) the cutout 43 of the dispensing body 42 that is positioned in the dispensing position. The closure device 80 restrains (i.e. encloses or constrains) the paper towels in the dispensing body 42 that is positioned in the dispensing position as the paper towels move or dispense through the dispensing body 42. The closure device 80 comprises a first surface 81 that corresponds to the cutout 43 of the dispensing body 42, a second surface 84 that corresponds to the platform cutout 22, and a wear member 86 configured to contact the paper towels as the paper towels dispense from the downstream outlet 47 of the dispensing body 42 in the dispensing position. The first surface 82 and the second surface 84 correspond (or mate with) the cutout 43 and the platform cutout 22, respectively, to create a complete dispensing shape (e.g. truncated cone) to prevent snagging of paper towels on recessed and/or protruding surfaces (i.e. side surfaces of the dispensing body 42 at the cutout 22 correspond with and abut side surfaces of the closure device 80; the first surface 82 corresponds with the surface 60 of the dispensing body 42; the second surface 84 is coplanar with the surface 24 of the platform 20 and/or the upper surface 52 of the dispensing body 42). In certain examples, the wear member 86 is downstream of the downstream outlet 47. The size and shape of the wear member 86 can vary. For example, the wear member 86 may be an open annulus, a cube, a hemisphere, a circle, or a partial cylinder. In certain examples, the wear member 86 is an open annulus having a radius greater than the outlet radius 49.

Figure 7:
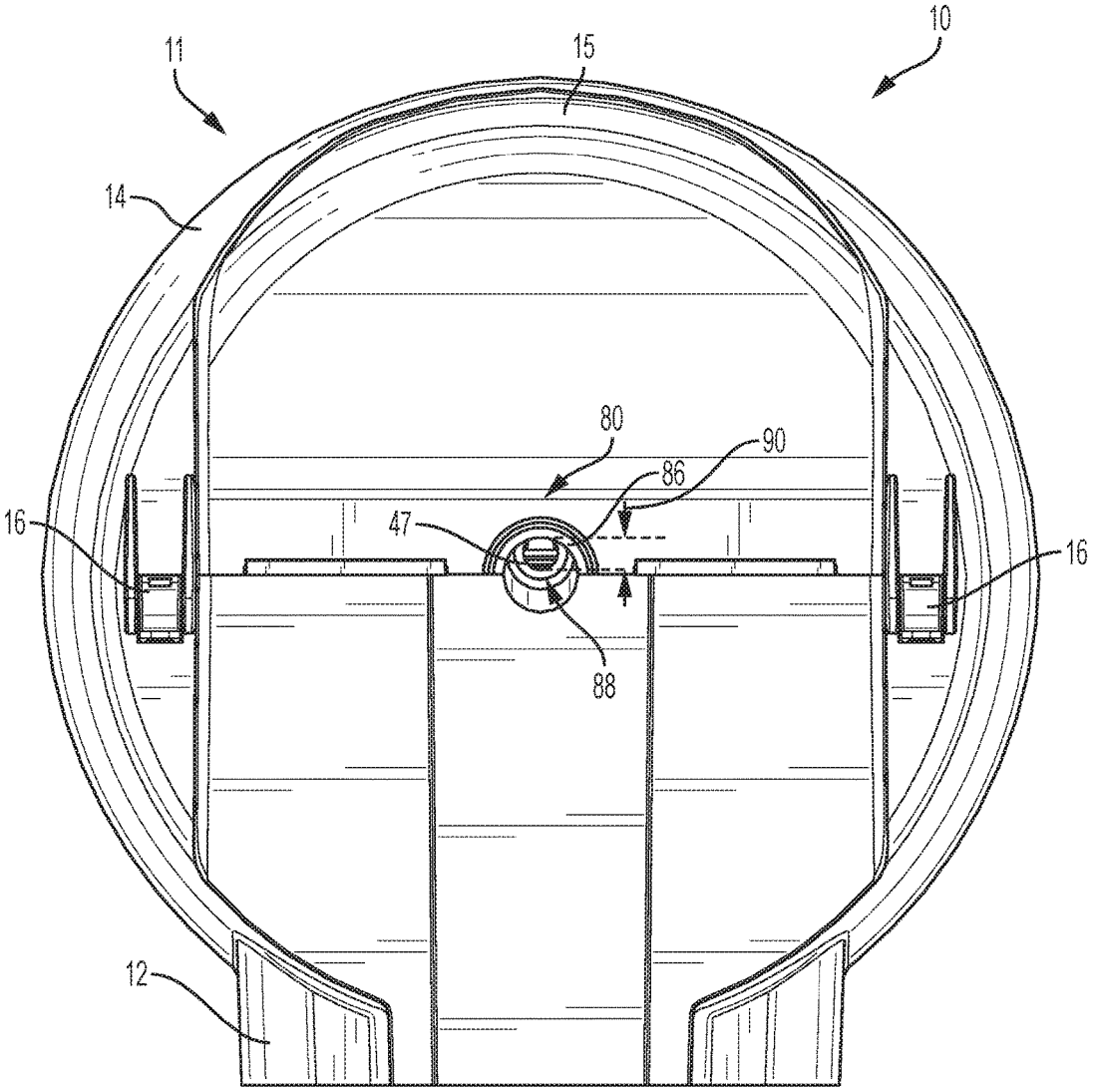
FIG. 7 is a bottom view of the paper towel dispenser of FIG. 1.
Figure 8:
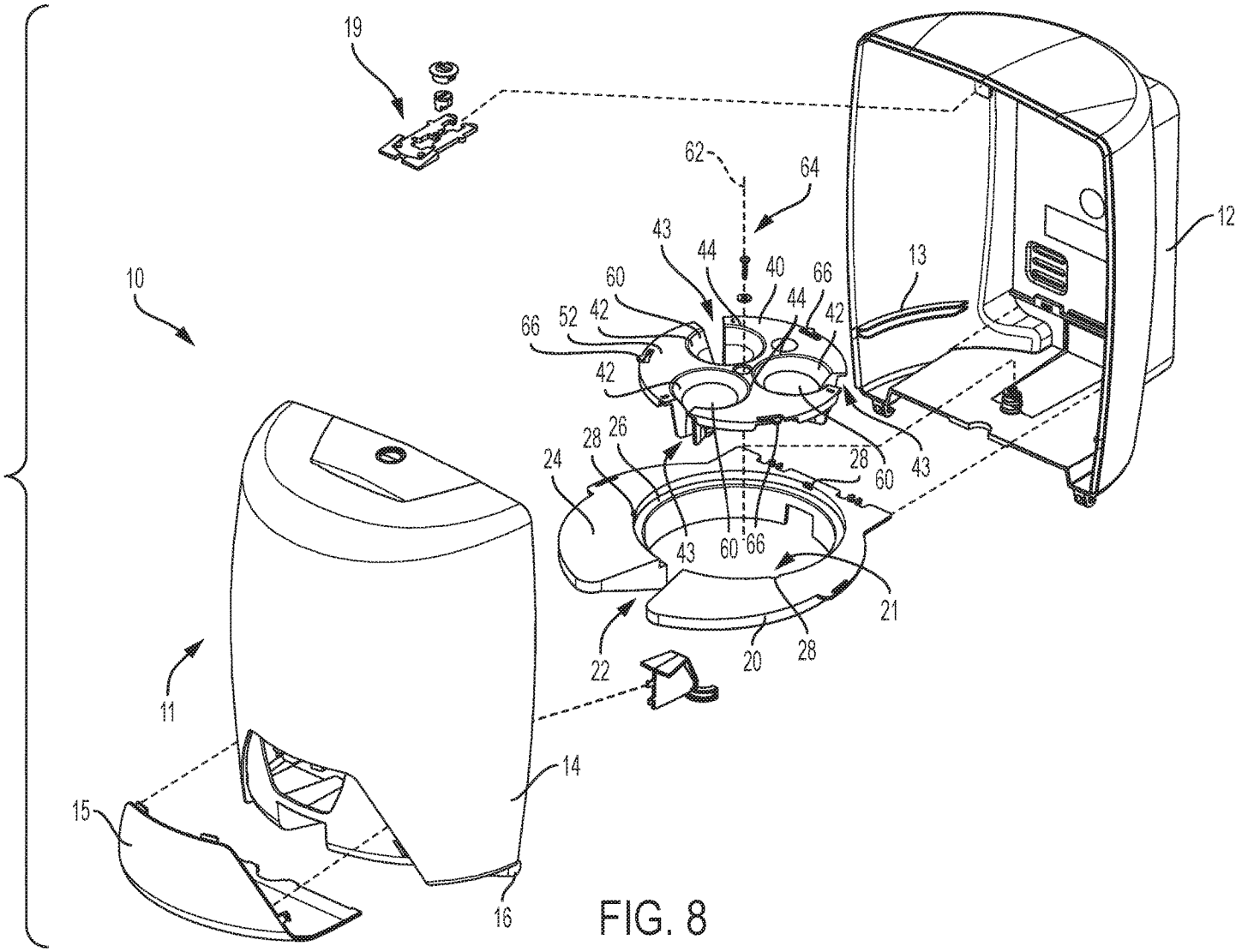
FIG. 8 is an exploded view of the paper towel dispenser of FIG. 1

Referring to FIG. 7, the wear member 86 and the downstream outlet 47 define a dispensing opening 88 through which the paper towels dispense through. The dispensing opening 88 has a dispensing opening distance 90 defined between the wear member 86 and the downstream outlet 47. As the paper towels are dispensed from the dispensing body 42 (see FIG. 8), the paper towels are drawn across and into contact with the wear member 86 as a consumer pulls the paper towels radially away from the base 12. Over time the wear member 86 wears (i.e. due to frictional forces between the wear member 86 and the paper towels) such that the dispensing opening distance 90 increases. In certain examples, a first dispensing body 42 is configured to rotate out of or away from the dispensing position as the wear member 86 wears such that a second dispensing body 42 is rotated into the dispensing position to thereby maintain the dispensing opening distance 90 (i.e. the distance 51 between the outlet axis 48 defined by the second dispensing body 42 and the center axis 62 is greater than the distance 51 between the outlet axis 48 defined by the second dispensing body 42 and the center axis 62 such that rotation of the second dispensing body 42 to the dispensing position maintains the dispensing opening distance 90 (as described above and depicted in FIGS. 13A-13C)).

Figure 15:
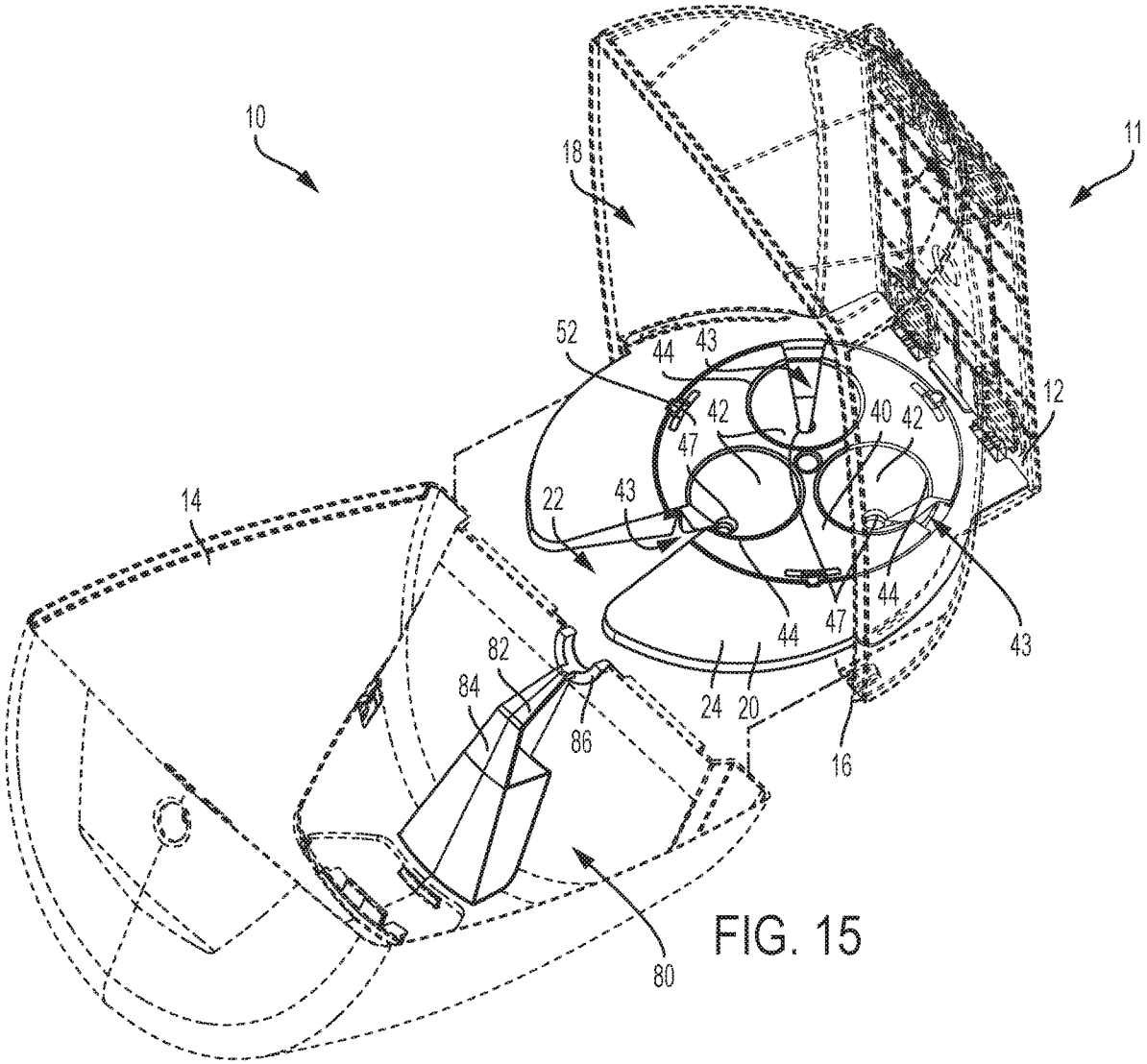
FIG. 15 is the paper towel dispenser of FIG. 1 with a door in a second position, a closure device coupled to a door (the door and a base are depicted in dashed lines) and the door separated from a hinge.
Figure 16:
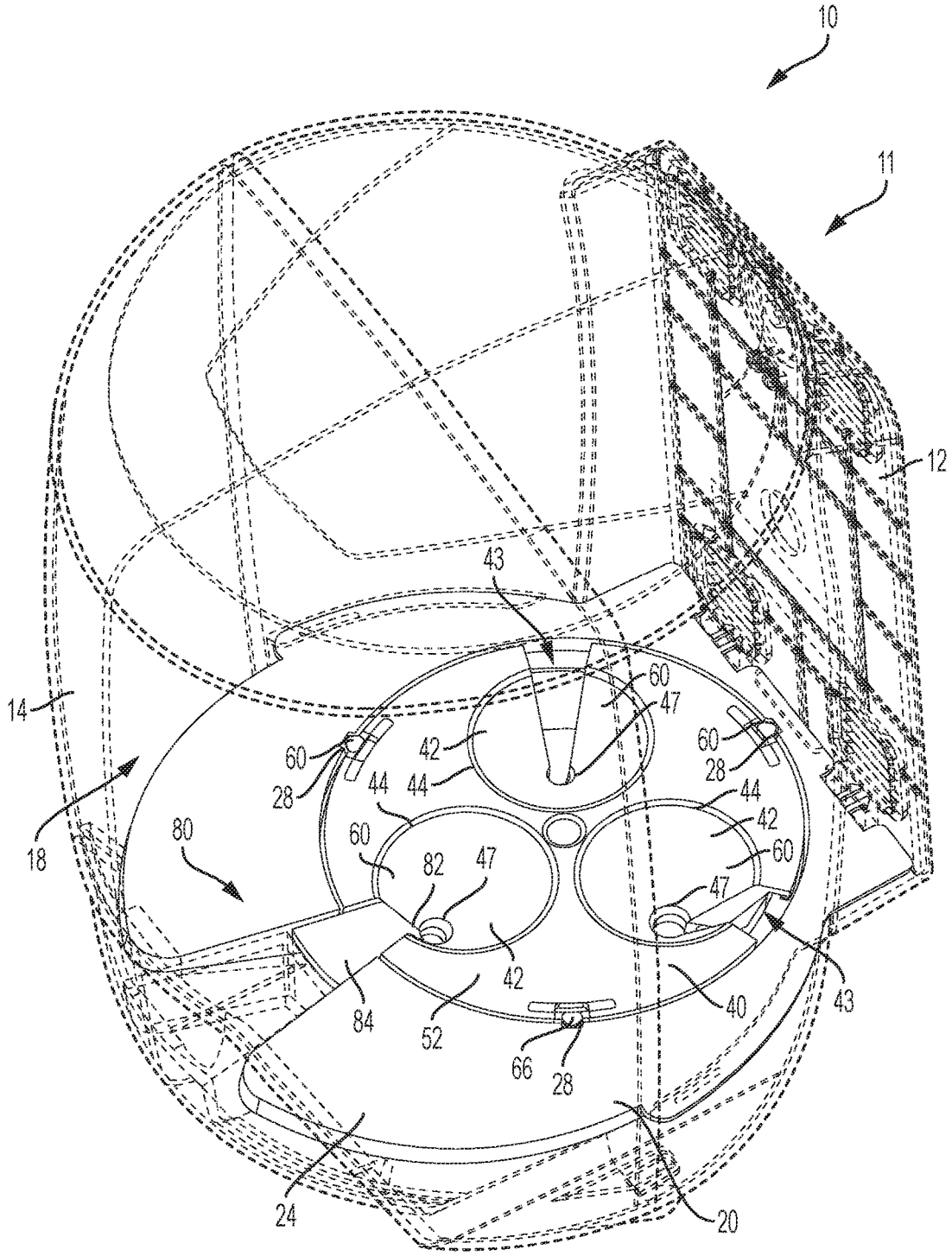
FIG. 16 is a paper towel dispenser of FIG. 1 with the door in a first position (the door and the base are depicted in dashed lines).

With reference to FIGS. 15 and 16, an example operational sequence is depicted and described below. The operator moves the door 14 relative to the platform 20 from a first position (see FIG. 16), in which the interior space 18 is not accessible and/or the continuous roll of paper towels is covered, to a second position (see FIG. 15), in which the interior space 18 is accessible. In this example, the closure device 80 is coupled to the door 14 such that the closure device 80 is configured to be received in the cutout 22 when the door 14 is in the first position (see FIG. 16) and to move relative to (i.e. move away from) the platform 20 and out of the cutout 22 when the door 14 is in the second position (see FIG. 15). While the door 14 is in the second position (see FIG. 15), the operator moves the desired dispensing body 42 into the dispensing position by rotating the carousel 40. The operator then places the continuous roll of paper towels onto the platform 20 and moves a length of paper towel sheet from the continuous roll of paper towels through the cutout 43 and/or the platform cutout 22 such that the paper towels are loaded or staged in the dispensing body 42 and the downstream-most paper towel or a portion of the downstream-most paper towel is downstream of the downstream outlet 47. The operator then moves the door 14 to the first position (see FIG. 16), such that the closure device 80 is received in the cutout 43 to restrain the paper towels in the dispensing body 42. The first surface 81 of the closure device 80 is positioned at or fills the cutout 43 of the dispensing body 42, and the second surface 84 of the closure device 80 corresponds is positioned at or fills the platform cutout 22.

In the present description, certain terms have been used for brevity, clearness and understanding. No unnecessary imitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

I claim:

1. A paper towel dispenser configured to dispense paper towels from a continuous roll of paper towels, the paper towel dispenser comprising:

a platform configured to support the continuous roll of paper towels, the platform having a platform surface, a perimeter edge, a platform opening extending through the platform, and a platform cutout extending between the platform opening and the perimeter edge;

a dispensing body received in platform opening and configured to dispense paper towels there through, wherein the dispensing body comprises an upstream inlet configured to receive the paper towels, a downstream outlet configured to dispense the paper towel, and a cutout extending between the upstream inlet and the downstream outlet, wherein paper towels are moved through the cutout of the dispensing body and the platform cutout to thereby load the paper towels into the dispensing body; and a closure device configured restrain the paper towels in the dispensing body, the closure device comprises a first surface that corresponds to and is selectively received into the cutout of the dispensing body and a second surface that corresponds to and is selectively received into the platform cutout.

2. The paper towel dispenser according to claim 1, wherein the second surface of the closure device is coplanar with the platform surface, and wherein the second surface of the closure device and the platform surface form a continuous planar surface when the second surface is received in the platform cutout.

3. The paper towel dispenser according to claim 2, wherein the closure device further comprises a wear member configured to contact the paper towels as the paper towels dispense.

4. The paper towel dispenser according to claim 3, wherein the wear member is downstream of the downstream outlet.

5. The paper towel dispenser according to claim 4, wherein the downstream outlet has an outlet radius; and wherein the wear member is an open annulus that has a radius greater than the outlet radius.

6. The paper towel dispenser according claim 3, further comprising:

a door configured to move relative to the platform into and between a first position in which the door is configured to cover the continuous roll of paper towels and a second position in which the continuous roll of paper towels is exposed, wherein the closure device is coupled to the door such that the first surface of the closure device is received into the cutout of the dispensing body and the second surface of the closure device is received into the platform cutout when the door is in the first position.

7. The paper towel dispenser according to claim 2, wherein the dispensing body has a dispensing body surface extending between the upstream inlet and the downstream outlet, and wherein the first surface of the closure device and the dispensing body surface form a truncated cone when the first surface is received in the cutout of the dispensing body.

8. A paper towel dispenser for dispensing paper towels from a continuous roll of paper towels, the paper towel dispenser comprising:

a housing defining an interior space;

a platform configured to support the continuous roll of paper towels, the platform is disposed in the interior space and coupled to the housing, the platform has a platform surface, a perimeter edge, a platform opening extending through the platform, and platform cutout extending between the platform opening and the perimeter edge; and a carousel rotatably received in the platform opening and having a plurality of dispensing bodies extending away from the platform surface, wherein the carousel has a carousel surface that is coplanar with the platform surface, wherein the plurality of dispensing bodies are configured to selectively dispense paper towels there through, and wherein the carousel is configured to rotate in the platform opening such that one of the plurality of dispensing bodies is positioned in a dispensing position and the paper towels are configured to dispense through the dispensing body positioned in the dispensing position.

9. The paper towel dispenser according to claim 8, wherein the each of the plurality of dispensing bodies comprise a downstream outlet configured to dispense the paper towels; wherein each downstream outlet defines an outlet radius; and wherein the outlet radii are equivalent.

10. The paper towel dispenser according to claim 9, wherein each of the plurality of dispensing bodies comprise an upstream inlet configured to receive the paper towels;

wherein each of the plurality of dispensing body defines a cutout that extends between the upstream inlet and the downstream outlet; and wherein the paper towels are configured to move through the cutout of the dispensing body positioned in the dispensing position to thereby load paper towels into the dispensing body; and further comprising a closure device that is selectively received into the cutout of the dispensing body positioned in the dispensing position to restrain the paper towels in the dispensing body positioned in the dispensing position.

11. The paper towel dispenser according to claim 10, wherein the closure device further comprises a wear member configured to contact the paper towels as the paper towels dispense from the downstream outlet of the dispensing body positioned in the dispensing position;

wherein the wear member and the downstream outlet define a dispensing width there between; and wherein the wear member wears as the paper towels dispense thereby increasing the dispensing width;

wherein the carousel defines a center axis and each of the downstream outlets defines an outlet center axis;

wherein a first dispensing body of the plurality of dispensing bodies defines a first outlet center axis that is spaced apart from the center axis by a first distance;

wherein a second dispensing body of the plurality of dispensing bodies defines a second outlet center axis that is spaced apart from the center axis by a second distance which is greater than the first distance; and wherein the first dispensing body is configured to rotate out of the dispensing position as the wear member wears such that the second dispensing body is rotates into the dispensing position to thereby maintain the dispensing width.

12. The paper towel dispenser according to claim 11, wherein each upstream inlet defines an inlet radius; wherein the inlet radii are equivalent; and wherein each upstream inlet defines an inlet center axis that is equidistant from the center axis.

13. The paper towel dispenser according claim 12, wherein the housing comprises a door configured to move relative to the platform; wherein the closure device is coupled to the door; and wherein the door moves into and between a first position in which the door covers the continuous roll of paper towels and the closure device is configured to be received in the cutout and a second position in which the door and closure device are configured to move relative to the platform to expose the dispensing body.

14. The paper towel dispenser according to claim 13, wherein the platform defines a platform cutout through which the paper towels are moved into the dispensing body positioned in the dispensing position.

15. The paper towel dispenser according to claim 8, wherein the each of the plurality of dispensing bodies comprise a downstream outlet configured to dispense the paper towels, wherein each downstream outlet defines an outlet radius; and wherein the outlet radii vary.

16. The paper towel dispenser according to claim 15, wherein each of the plurality of dispensing bodies comprise an upstream inlet configured to receive the paper towels and wherein the downstream outlet is configured to dispense the paper towel;

wherein each of the plurality of dispensing body defines a cutout that extends between the upstream inlet and the downstream outlet through which the paper towels are moved into the dispensing body positioned in the dispensing position; and further comprising a closure device configured to be received in the cutout of the dispensing body positioned in the dispensing position and restrain the paper towels in the dispensing body positioned in the dispensing position.

17. The paper towel dispenser according claim 16, wherein the housing comprises a door configured to move relative to the platform; wherein the closure device is coupled to the door; and wherein the door moves into and between a first position in which the door covers the continuous roll of paper towels and the closure device is configured to be received in the cutout and a second position in which the door and closure device are configured to move relative to the platform to expose the dispensing body.

18. The paper towel dispenser according to claim 17, wherein the platform defines a platform cutout through which the paper towels are moved into the dispensing body positioned in the dispensing position.

19. A carousel for a paper towel dispenser configured to dispense paper towels from a continuous roll of paper towels, the carousel comprising:

a plurality of dispensing bodies that are configured to dispense paper towels there through, wherein the carousel is configured to rotate about a center axis such that one of the plurality of dispensing bodies is positioned in a dispensing position and the paper towels dispense through the dispensing body positioned in the dispensing position;

wherein each of the dispensing bodies has an upstream inlet configured to receive the paper towel and a downstream outlet configured to dispense the paper towel;

wherein each of the dispensing bodies defines a cutout that extends between the upstream inlet and the downstream outlet through which the paper towels are moved to thereby load the paper towels into the dispensing body positioned in the dispensing position;

wherein each of the dispensing bodies has an inlet center axis and an outlet center axis that is radially offset from the inlet center axis, and wherein the inlet center axis of each of the dispensing bodies are equidistant from the center axis; and wherein each of the dispensing bodies has an inlet radius, and wherein the inlet radius of each of the dispensing bodies are equivalent.

* * * * *